US007063484B2

(12) United States Patent
Meeks et al.

(10) Patent No.: US 7,063,484 B2
(45) Date of Patent: Jun. 20, 2006

(54) BOAT BARRIER ATTACHMENT FOR LOG AND DEBRIS BOOMS

(76) Inventors: Paul S. Meeks, 252 - 23rd St. NW., Canton, OH (US) 44709; Jeffrey S. Sanger, 1156 NE. Oceanview Cir., Jensen Beach, FL (US) 34957

( * ) Notice: Subject to any disclaimer, the term of this patent is extended or adjusted under 35 U.S.C. 154(b) by 0 days.

(21) Appl. No.: 10/604,310

(22) Filed: Jul. 10, 2003

(65) Prior Publication Data

US 2004/0115002 A1 Jun. 17, 2004

Related U.S. Application Data

(60) Provisional application No. 60/319,707, filed on Nov. 19, 2002.

(51) Int. Cl.
*B63G 9/00* (2006.01)

(52) U.S. Cl. ..... 405/60; 114/241

(58) Field of Classification Search ..... 405/60, 405/60.5, 63; 114/240 R, 241
See application file for complete search history.

(56) References Cited

U.S. PATENT DOCUMENTS

| | | | | |
|---|---|---|---|---|
| 1,151,607 | A * | 8/1915 | Newhall et al. | 114/241 |
| 2,369,464 | A * | 2/1945 | Kalnitz | 114/240 R |
| 4,738,563 | A * | 4/1988 | Clark | 405/52 |
| 6,681,709 | B1 * | 1/2004 | Nixon et al. | 114/241 |

* cited by examiner

*Primary Examiner*—John Kreck
(74) *Attorney, Agent, or Firm*—Zollinger & Burleson Ltd.

(57) ABSTRACT

A watercraft barricade device (1) having a suspended barricade (5) affixed at predetermined positions to vertical risers (3) which shall be mounted to floating log and debris booms or floating booms (7) that when deployed will prevent watercraft from progressing beyond an established perimeter for the protection of structures or areas accessible from a body of water.

13 Claims, 3 Drawing Sheets

BOAT BARRIER ATTACHMENT FOR LOG AND DEBRIS BOOMS

CROSS REFERENCE TO RELATED APPLICATIONS

This application is the Non-provisional Patent Application of Provisional Patent Application No. 60/319,707, filed Nov. 19, 2002.

BACKGROUND OF INVENTION

This invention relates to increasing the protections which are provided by floating log and debris boom type devices for structures situated upon, within or adjacent to a navigable body of water from approach or attack by a watercraft, particularly a barrier device that can be attached to a log and debris boom type device or series of end-to-end connected booms to prevent progression of watercraft.

DESCRIPTION OF PRIOR ART

Operators of structures situated on or along a body of water such as dams, water intakes, critical infrastructure, recreation areas and platforms employ a variety of methods to create floating or suspended waterway barriers intended to prevent the progression of surface borne matter towards their facilities. The earliest forms of such barriers consisted of logs or railroad ties soaked in Creosote to prevent water absorption and prolong their utility. These were then attached end-to-end in a line and positioned across a body of water being anchored at each shore to create a floating barricade against logs, debris, and other surface borne matter. More recent commercial attempts consist of a molded, buoyant boom type device that provides many functional and environmental advantages over the coated log attempts. While many facilities still use the log/railroad tie method, the commercial attempts have achieved a widespread and rapidly growing use.

The prior art including commercially available attempts were designed for the intended purpose of a boom line to prevent surface borne logs and debris from advancing along a waterway. These attempts are also generally effective as a barrier against small, non-mechanically propelled watercraft. That such attempts can be produced in various colors and or imprinted with visible lettering further enhances their utility as a boat barrier by way of alerting boaters to the boom line thereby contributing to the prevention of an unintentional breach of the line. The present invention can be attached to these prior attempts to provide additional utility to stop many types of watercraft.

Recent geopolitical events have made the protection of structures situated on or along a body of water such as dams, water intakes, critical infrastructure, recreation areas and platforms from intentional attack utilizing a watercraft a national security priority. Prior to the terrorist attacks of Sep. 11, 2001, log and debris booms were generally required to stop floating logs and debris. Today however, the basic requirement of blocking floating logs and debris remains, but an additional capacity for blocking certain watercraft intent on inflicting damage is critical. The present invention can be attached to existing booms thereby increasing their capacity to block watercraft.

U.S. patent application Ser. No. 10/248203 "Watercraft Barrier Device and System" describes a device specifically intended as a watercraft barrier. This attempt is an ideal solution to meet the specific need for blocking watercraft.

This attempt is a stand-alone system that must be purchased and installed separate from any previously installed log and debris boom type systems and is therefore an unlikely or unrealistic option for users seeking to improve their existing boom lines. The present invention provides a modification for currently available or installed boom systems that increases their capacity to block watercraft thereby raising their utility to meet current needs without requiring replacement or installation of a separate watercraft barrier specific device.

Many structures are situated upon or accessible by a body of water that is only navigable by a very limited range of mechanically propelled watercraft typically consisting of inflatable, flat-bottomed or pontoon type craft possessing minimal water displacement and draft properties. In these situations the attempt proposed by U.S. patent application Ser. No. 10/248203 Watercraft Barrier Device and System may work but would generally be too much for the application. While such situations still require that preventative measures be employed to block the intentional, propelled progression of a watercraft there exists a need for a device that is scaled to the conditions in which it is to be employed and is attachable to existing measures. The present invention provides a modification for currently available or installed boom systems that increases their function to block watercraft. The present invention enables existing boom systems to be upgraded to address current security needs respective of the conditions within which they are, or will be, employed.

OBJECTS AND ADVANTAGES

In view of the deficiency of the prior art to provide a cost effective, additive alternative to meet current protective requirements for dams, water intakes, critical infrastructure, recreation areas, platforms and other structures, there exists a need for a watercraft barrier device that can be attached to a log and debris boom type line.

Besides the objects and advantages of the boat barrier attachment for log and debris boom type devices described in the present invention, several objects and advantages of the present invention are:

To provide an attachment to floating booms that increases their ability to block watercraft.

To provide an attachment to floating booms which can prevent intentional and unintentional breach by a watercraft.

To provide an attachment to floating booms which creates an above or below water surface barricade that exceeds the periphery of said boom.

To provide an attachment to floating booms that will provide a support structure to which a suspended watercraft barricade can be affixed.

To provide an attachment for supporting a suspended watercraft barricade to floating booms which can be mounted to the booms using a plurality of methods which may be determined by user specifications.

To provide a watercraft barricade which can be suspended above or below a boom device.

To provide a suspended watercraft barricade which can be comprised of a plurality of materials which may be determined by user specifications.

DETAILED DESCRIPTION

Figure 1:
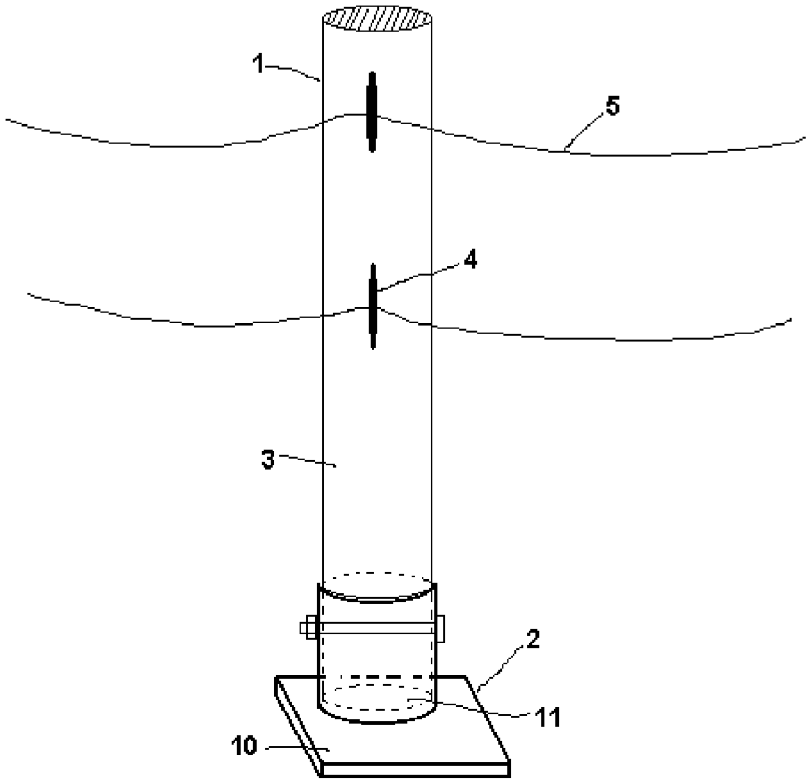
FIG. 1: is a perspective view of the boat barrier attachment device showing the support riser attached to a base mounting mechanism, hangar mechanisms, and the suspended barricade in a typical installation position passing through the hangar mechanisms.
Figure 1A:
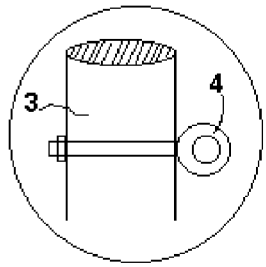

Referencing now to the drawings FIG. 1 illustrates a perspective view of the preferred embodiment of the boat barrier attachment device represented by numeral (1). Generally the boat barrier attachment entails a base mounting mechanism (2) consisting of a horizontal base plate (10) affixed to a vertical support riser receptacle (11) to which a support riser (3) is inserted or attached, and hangar mechanisms (4) affixed at variable positions along the support riser support a watercraft barricade (5) which is then suspended between a succession of support risers affixed to a line of end to end connected floating log and debris booms or floating boom type devices (7). FIG. 1A illustrates a perspective cut out sectional side view of a hangar mechanism (4) mounted on the vertical support riser (3).

Figure 2:
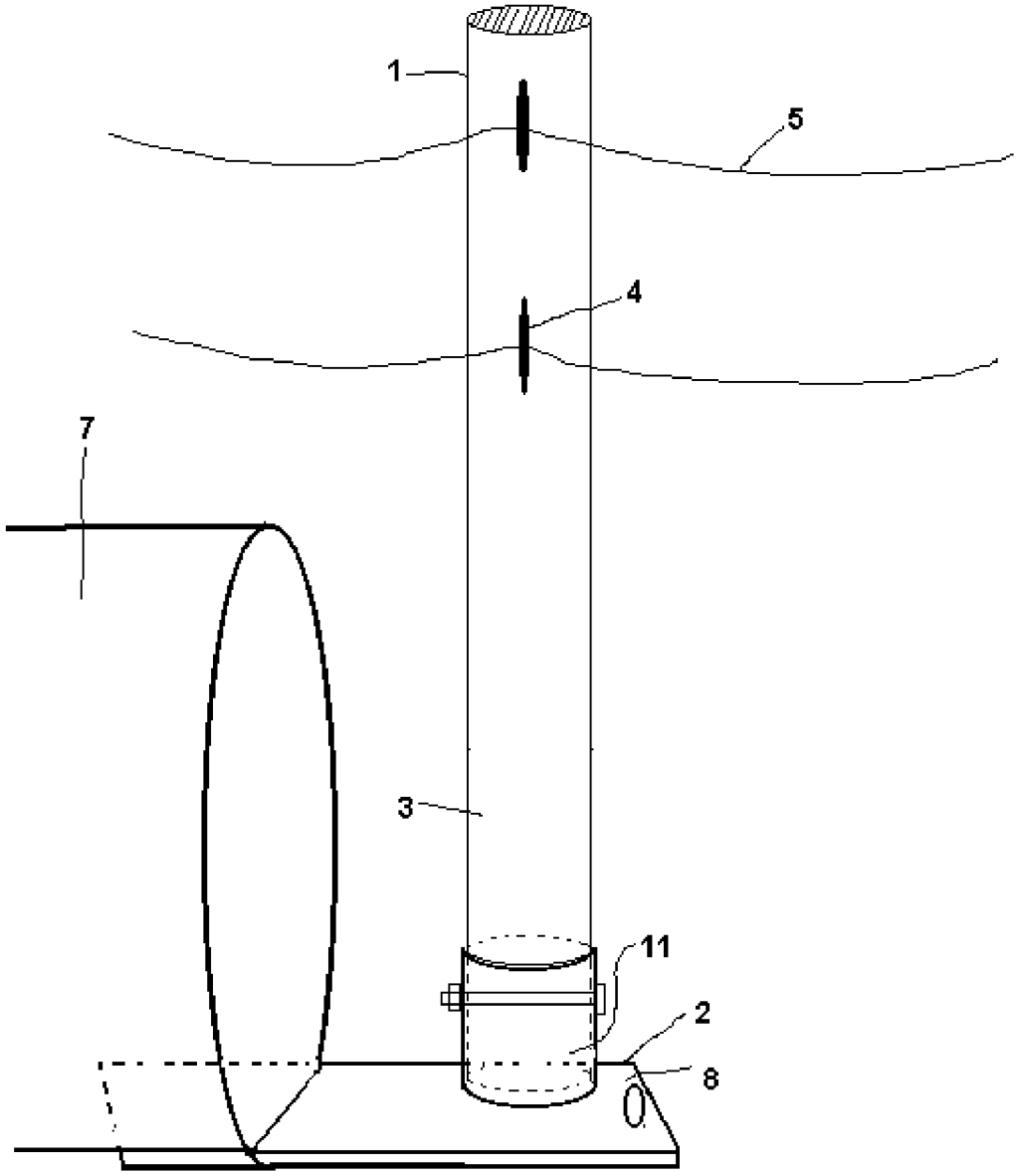
FIG. 2: is a perspective view of the boat barrier attachment showing the preferred installation position with the base mounting device affixed to the log and debris boom coupling mechanism, and preferred suspended barricade consisting of a coated wire rope suspended from the hangar mechanisms.

Referencing now to the preferred operation of the preferred embodiment of the present invention illustrated in FIG. 2. Generally, the boat barrier attachment device (1) is affixed to the coupling mechanisms (8), situated at each end of a floating boom, that connect a series of floating booms end-to-end. The boat barrier attachment device is secured at its base by any appropriate means of positive fixation as determined by the user of the boat barrier attachment device. The support riser shall extend vertically beyond the apex of the adjacent floating booms to such height predetermined by the user as necessary to achieve an effective suspended boat barrier. The hangar mechanisms will support the watercraft barricade which will be suspended from support risers affixed to a plurality of end-to-end connected floating booms. Operation of the present invention may be achieved by affixing the base mounting mechanism and vertical support riser to the top side or bottom side of the coupling mechanism or boom thereby providing a boat barrier both above and below the water surface. The primary purpose of the present invention is to provide an attachment to floating booms that increases their utility and effectiveness to prevent the progression of watercraft beyond the boom line both above and below the water surface.

Figure 3:
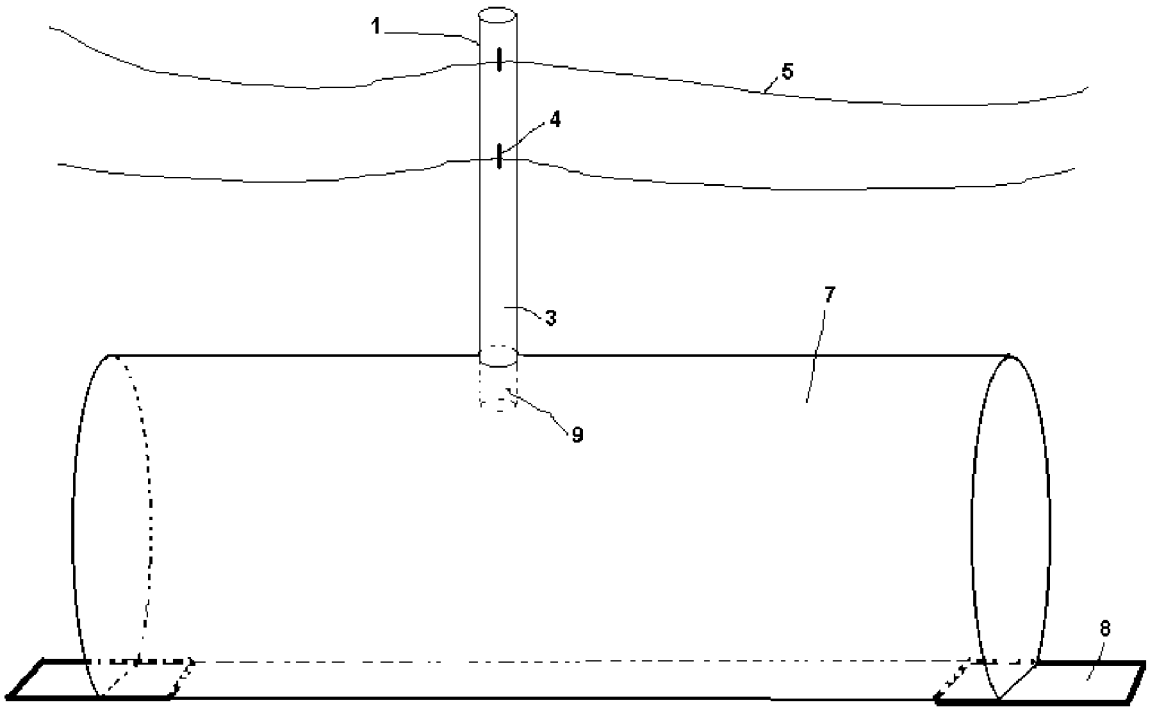
FIG. 3: is a perspective view of the boat barrier attachment showing an alternate installation position with the support riser inserted into a receptor hole created in a log and debris boom, and suspended barricade.

An additional embodiment is shown in FIG. 3 whereby the base mounting mechanism is eliminated and the support riser is mounted directly to a floating boom.

The invention claimed is:

1. A boat barrier system, comprising:

a plurality of consecutive floating boom assemblies connected end to end;

each of the floating boom assemblies having a floating boom and a base mounting mechanism;

each floating boom having a first end, a second end, a top portion adapted to be disposed above the water when the boom is in the water, and a bottom portion adapted to be adjacent the water when the boom is in the water;

the base mounting mechanisms cantilevered from the bottom portion of the floating booms;

the base mounting mechanisms of consecutive booms being connected together;

a plurality of support risers; each support riser having an upper portion and a lower portion;

the support risers being connected to the floating boom assemblies with the upper portions of the support risers being disposed higher than the top portion of the floating booms; and a barrier cable connected to the support risers.

2. The system of claim 1, further comprising a hanger connecting the barrier cable to the support riser.

3. The system of claim 1, wherein the lower portions of the support risers are connected to the base mounting mechanisms.

4. The system of claim 3, wherein each floating boom assembly supports a pair of support risers with the floating boom disposed between the support risers.

5. The system of claim 4, wherein each base mounting mechanism includes a support riser receptacle that receives the lower portion of the support riser.

6. The system of claim 1, wherein the lower portions of the support risers are connected to the floating booms.

7. A boat barrier system, comprising:

a plurality of consecutive floating boom assemblies connected end to end;

each of the floating boom assemblies having a floating boom and a base mounting mechanism;

each floating boom having a first end, a second end, a top portion adapted to be disposed above the water when the boom is in the water, and a bottom portion adapted to be adjacent the water when the boom is in the water;

the base mounting mechanisms cantilevered from the bottom portions of the ends of the floating booms; the base mounting mechanisms being adapted to be parallel to the water surface;

the base mounting mechanisms of consecutive booms being connected together;

a plurality of support risers; each support riser having an upper portion and a lower portion;

the support risers being connected to the base mounting mechanisms with the upper portions of the support risers being disposed higher than the top portion of the floating booms;

each floating boom assembly having a pair of support risers with the floating boom disposed between the support risers; and a barrier cable connected to the support risers.

8. The system of claim 7, wherein each base mounting mechanism includes a support riser receptacle that receives the lower portion of the support riser.

9. The system of claim 7, further comprising a plurality of hangers connecting the barrier cable to the support risers.

10. A boat barrier system, comprising:

a plurality of consecutive floating boom assemblies connected end to end;

each of the floating boom assemblies having a floating boom and a base mounting mechanism;

each floating boom having a first end, a second end, a top portion adapted to be disposed above the water when the boom is in the water, and a bottom portion adapted to be adjacent the water when the boom is in the water;

the base mounting mechanisms of consecutive booms being connected together;

a plurality of support risers; each support riser having an upper portion and a lower portion;

the lower portions of the support risers being connected to the base mounting mechanisms with the upper portions of the support risers being disposed higher than the top portion of the floating booms; and a barrier cable connected to the support risers.

11. The system of claim 10, further comprising a hanger connecting the barrier cable to the support riser.

12. The system of claim 10, wherein each floating boom assembly supports a pair of support risers with the floating boom disposed between the support risers.

13. The system of claim 10, wherein each base mounting mechanism includes a support riser receptacle that receives the lower portion of the support riser.

* * * * *